US006805340B2

(12) United States Patent
Silberbauer

(10) Patent No.: US 6,805,340 B2
(45) Date of Patent: Oct. 19, 2004

(54) DEVICE FOR PRODUCING BOUND PRINTED PRODUCTS

(75) Inventor: Günther Silberbauer, Uerkheim (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/350,414

(22) Filed: Jan. 24, 2003

(65) Prior Publication Data

US 2003/0146557 A1 Aug. 7, 2003

(30) Foreign Application Priority Data

Feb. 7, 2002 (EP) ..... 02405085

(51) Int. Cl.[7] ..... B65H 5/32

(52) U.S. Cl. ..... 270/38; 270/52.16; 270/52.26; 270/52.29; 270/52.3

(58) Field of Search ..... 270/38, 52.16, 270/52.26, 52.22, 52.29, 52.3, 52.14; 412/4, 9–13

(56) References Cited

U.S. PATENT DOCUMENTS

| | | | | |
|---|---|---|---|---|
| 4,595,187 A | | 6/1986 | Bober | 270/37 |
| 4,989,850 A | * | 2/1991 | Weller | 270/1.02 |
| 5,501,442 A | | 3/1996 | Mandel | 270/58.07 |
| 5,522,690 A | | 6/1996 | Pickering | 414/27 |
| 5,562,278 A | * | 10/1996 | Muller et al. | 270/58.21 |
| 5,887,863 A | * | 3/1999 | Hollenstein et al. | 270/52.18 |
| 6,120,427 A | | 9/2000 | Haan et al. | 493/442 |
| 2003/0214092 A1 | * | 11/2003 | Horii et al. | 270/52.18 |

FOREIGN PATENT DOCUMENTS

| | | | | |
|---|---|---|---|---|
| JP | 05294087 A | * | 11/1993 | B42B/9/04 |
| WO | 0134403 | | 5/2001 | |

* cited by examiner

*Primary Examiner*—Daniel J. Colilla
(74) *Attorney, Agent, or Firm*—Friedrich Kueffner

(57) ABSTRACT

A device for producing bound printed products has a continuous folding device to which are supplied sequentially individual printed sheets and in which the printed sheets are folded individually to folded printed sheets. A gathering device receives the folded printed sheets from the continuous folding device and gathers them in a predetermined number to a pre-product in a position in which the folded printed sheets are astraddle. A transport device is arranged downstream of the gathering device and receives the pre-product from the gathering device. The gathering device has at least one blade extending substantially parallel to the transport direction of the transport device. The folded printed sheets are gathered on the blade to form the pre-product. A device for moving the at least one blade in the transport direction is provided.

19 Claims, 3 Drawing Sheets

3
65
11
60
81
62
85
70
68
67
12
69
10
63
10
11

82
71
62
72
12
83
68
60
67
69
10
11
84
11

22
77
78
73
60
75

80
22
75
74
73
79
66
60
3
64
65
11
62

DEVICE FOR PRODUCING BOUND PRINTED PRODUCTS

BACKGROUND OF THE INVENTION

1. Field of the Invention

The invention relates to a device for producing bound printed products, comprising at least one continuous folding device to which individual printed sheets are sequentially supplied and in which these sheets are individually folded; further comprising a gathering device in which the printed sheets folded in the continuous folding device are gathered astraddle to a pre-product; and a transport device receiving the pre-products from the gathering device. The gathering device comprises at least one blade which extends substantially parallel to the transport direction of the transport device and on which a certain number of printed sheets are gathered to form a pre-product.

2. Description of the Related Art

Devices of this kind are suitable particularly for so-called on-demand production in connection with digital printing machines. Digital printing machines enable a continuous change of the printed image without having to stop the printing machine. In this way, it is basically possible to sequentially produce books and other printed products with different contents and different page quantities without interruption. In this way, it is also possible to inexpensively produce small editions of books and other printed products. The storage costs can be kept at a minimum. Since it is possible to operate in-line without interruption, it is therefore also possible to keep the required manufacturing time at a minimum.

A device of the aforementioned kind is known in the prior art from the publication WO 01/34403 A2. With this device, the printed sheets which have been folded in a continuous folding device are gathered on two hubs provided with vanes. These two hubs provided with vanes are positioned in a single plane which extends transversely to the transport direction of the continuous folding device. They move relative to one another such that at one end of the continuous folding device a roof-shaped support is formed by two vanes on which the printed products are gathered to a pre-product. Once the predetermined number of printed sheets has been gathered on these two vanes, the two vane hubs are rotated in opposite direction and the roof-shaped support moves downwardly. The printed products are accordingly spread apart. When the spreading angle is substantially approximately 180 degrees, the pre-product is received by a driver of the transport chain and is supplied to a stitching machine. After stitching, the pre-products are cut or trimmed to size in a trimming machine. In this device it is disadvantageous that the two vane hubs require laterally a lot of space and that the pre-products upon placement onto the transport device are spread apart greatly and thus become unstable.

SUMMARY OF THE INVENTION

It is an object of the present invention to provide a device of the aforementioned kind which is more compact and has a higher output.

In accordance with the present invention, this is achieved in that means are provided with which the blade is movable in the transport direction.

In the device according to the invention, instead of the vane hubs a blade is used which requires significantly less space. The pre-products gathered on this blade are deposited substantially without spreading on the transport device. The placement without additional spreading can be carried out particularly advantageously by a linear movement of the blade. Once the pre-product is substantially completely removed or stripped off, it drops onto the transport device and is engaged by a driver of the transport device. The transport device must not be stopped, but it can be stopped for this purpose. Since the pre-products are not additionally spread apart, they are guided significantly more securely; this enables a higher speed and thus a higher output of the device.

According to a further embodiment of the invention, at least two substantially identical blades are provided on which sequentially a pre-product is gathered, respectively. Once on one of the blades a pre-product is completed, on the second blade a second pre-product can be gathered without interruption.

A particularly high production output is possible when, according to a further embodiment of the invention, the gathering device has a wheel-shaped carrier on which several blades are supported. Upon rotation of the wheel-shaped carrier, the blades move from the continuous folding device to the transport device. The blades move in one plane which extends vertically and parallel to the transport device. Such a carrier extends in the vertical direction and in the longitudinal direction but only insignificantly laterally so that a compact configuration is still possible. The blades of the wheel-shaped carrier are preferably embodied such that the have a passage at their upper edge, respectively. Upon rotation of the carrier, the blades can then pass substantially vertically a transport chain and deposit the pre-product thereon in this way. The supply of the printed sheets to the wheel-shaped carrier as well as the transport away from the carrier are realized, respectively, substantially radially relative to the wheel-shaped carrier. Each blade is preferably provided with a stop where the printed sheet or the pre-product is positioned. It is important that the pre-products upon deposition are not spread apart in this connection. The pre-products can thus be safely received by the drivers of the transport device.

According to another embodiment of the invention, two blades are provided, which are arranged at a spacing to one another above the transport device, and a deflecting switch is provided with which the printed sheets are supplied alternatingly to the two blades. The deflecting switch is preferably actuated or switched such that the pre-products are alternatingly gathered on the two blades. The two blades are preferably arranged directly above the transport device so that the pre-products can be transferred without spreading and with a short movement onto the transport device. Preferably, in this connection the blades are moved parallel to the transport direction and the pre-products are stripped off. After retraction of a blade, the corresponding pre-product is then immediately received by a driver of the transport device. Each blade has correlated therewith a continuous folding device. In principal, it is also possible to employ more than two blades, two continuous folding devices, and; accordingly, several deflecting switches. This embodiment enables a particularly high output while providing a compact configuration.

According to another embodiment of the invention, at least two blades are positioned above one another. These blades can be moved from a gathering position into a retracted waiting position. This provides a very compact arrangement with which it is also possible to gather alternatingly on these blades. For this purpose, the lower blade is, for example, in the gathering position while the upper blade is still in the retracted position. When the gathering process on the lower blade is finished, the upper blade moves into the gathering position above the lower blade and the lower blade transfers the pre-product onto the transport device. Subsequently, the lower blade moves back into the gathering position and receives the already gathered printed sheets from the upper blade in that the upper blade is retracted and the sheets are stripped off.

If desired, before transporting the pre-product away, a folded envelope can be added to the pre-product.

According to another embodiment of the invention, the pre-products are stitched and subsequently moved into a belt transport device. Clamped between the transport belts, the pre-products are stopped sequentially at a bottom knife and a top knife and trimmed or cut to size. The transport is controlled advantageously as a function of the size of the product. After the top trim has been carried out, the front trim or cut is performed by means of a third knife. The product, which is now finished, moves onto a delivery belt, for example, along a chute.

DESCRIPTION OF THE PREFERRED EMBODIMENTS

Figure 1:
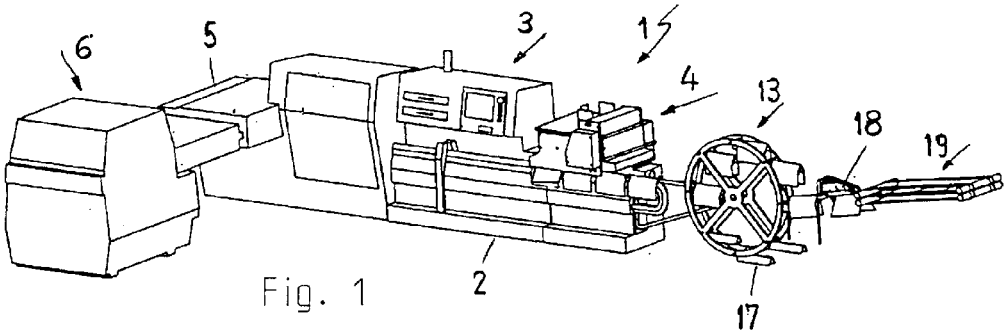
FIG. 1 shows a schematic perspective view of the device according to the invention.
Figure 2:
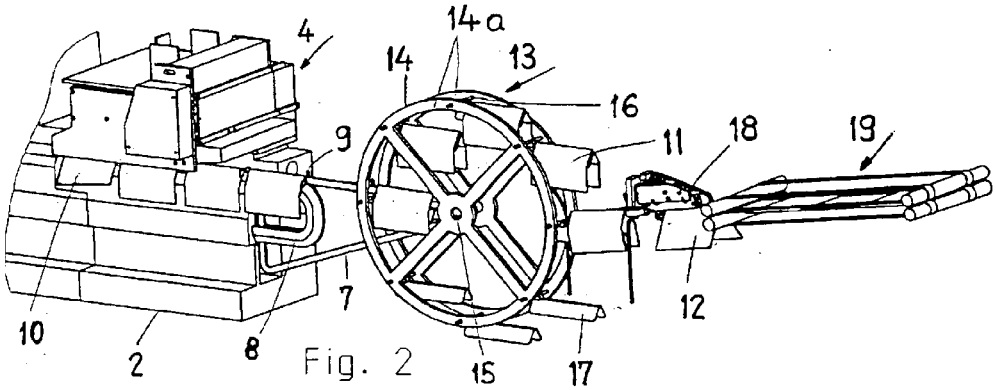
FIG. 2 shows schematically a perspective partial view of the device according to FIG. 1.

FIG. 1 shows a first embodiment of the device 1 according to the invention. At the right side of FIG. 1, a flow of printed sheets positioned adjacent to one another (not in an imbricated or shingle arrangement) and transversely folded preferably in a signature folder is shown. The printed sheets, folded as needed, are scored on a feed belt 19, as known in the art, and subsequently are folded longitudinally in a known continuous folding device 18. The transversely and longitudinally folded sheets 12 reach a gathering device 13 which, according to FIGS. 2 and 3, has a wheel-shaped carrier 14. According to FIG. 3, the carrier 14 is driven in rotation in the direction of arrow 23 in the counter clockwise direction about the hub 15. On the periphery of the wheel-shaped carrier 14, several blades 17 are arranged such that they are aligned preferably horizontally. The carrier 14 is comprised according to FIG. 2 of two parallel halves 14*a*. Each blade 17 is fastened with a short stay 16 on one of the halves 14*a*. In the three o'clock position, the corresponding blade 17 thus extends radially and horizontally away from the carrier 14. One end of the blade 17 is secured on a stay 16 while the free end projects radially outwardly.

The transversely and longitudinally folded sheets 12 are gathered to pre-products 11 on the gathering device 13. According to FIG. 3, the sheets 12 are transferred onto a blade 17 which is in the three o'clock position. Upon transfer of the sheets 12 to the corresponding blade 17, the sheet 12 is guided by means of guide rods 20. When depositing the sheets 12 onto the blade 17, the stays 16 of the blade 17 form a rearward stop. Once the number of printed sheets 12 required for a printed product have been deposited on the blade 17, it is moved farther in the direction of arrow 23 (FIG. 3) until a subsequent empty blade 17 reaches the three o'clock position and is ready for receiving the next sheets 12. The sheets 12 gathered on the blade 17 form a pre-product 11 to which is added at a later point in time an envelope 10 by means of an envelope feeder 4. The pre-products 11, which can be different from one another, are moved by a rotary movement, carried out by stepwise rotation of the carrier 14, into the nine o'clock position, respectively. In this position, the pre-product 11 is transferred by means of a narrow gathering chain 7 to a transport device 2 which preferably has a double gathering chain 8. This narrow gathering chain forms preferably the drive of the wheel-shaped carrier 14.

Figure 3:
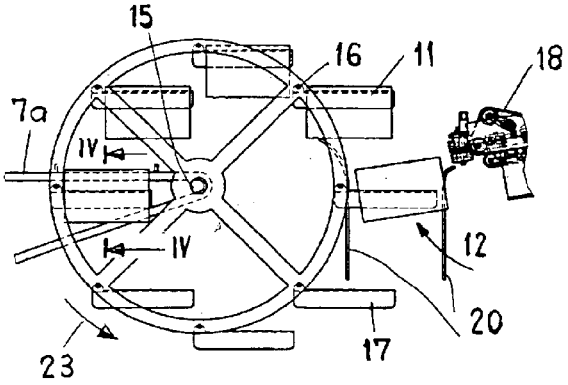
FIG. 3 shows schematically a side view of a portion of the device according to FIG. 1.
Figure 4:
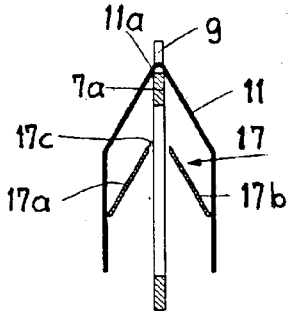
FIG. 4 shows a section along the line IV—IV of FIG. 3.

As shown clearly in FIG. 4, each of the blades 17 is divided in the longitudinal direction and has two roof-shaped surfaces 17*a* and 17*b* between which a continuous slot 17*c* is provided at an upper edge. This slot 17*c* is somewhat wider than the narrow gathering chain 7 such that the blade 17 can move past the gathering chain 7 from above in a downward direction. When doing so, the corresponding pre-product 11 is engaged by a driver 9 in the area of a longitudinal fold 11*a* and, as shown in FIG. 3, transported from the right to the left on the upper run 7*a* of the gathering chain 7. The pre-products 11 are transferred from the gathering chain 7 to the double gathering chain 8 of the transport device 2. It is significant in this connection that during the transfer of the pre-products 11 to the transport device 2 the pre-products 11 are safely guided and substantially are not spread apart. When a blade 17 has transferred a pre-product 11 onto the transport device 2, the blade 17 is moved in a stepwise movement back into the three o'clock position where it is ready for receiving more sheets 12. The gathering device 13 and the transport device 2 are preferably driven at the same cycle speed.

On the transport device 2 the pre-printed products 11 are moved to the envelope feeder 4 where an envelope 10 is supplied for each pre-product. Envelope feeders 4 are known to a person skilled in the art and require no further explanation. However, it is basically not mandatory that an envelope 10 is added to the pre-product 11.

Downstream of the envelope feeder 4 a stitching device 3 is arranged in which the pre-products 11 are stitched as is known in the art. Instead of the stitching device 3, a different kind of device with which the pre-printed products 11 are bound can be used. Downstream of the stitching device 3, the pre-printed products 11 are guided to a deflecting device 5 with which the stitched products, provided with an envelope 10 if needed, are transported in a horizontal plane transverse to the transport direction of the transport device 2 such that the stitched back is in a leading position. The pre-products 11 aligned in this way are moved to a trimmer or cutting device 6, for example, a three-knife trimmer, with which the pre-products are trimmed at the top, the bottom, and the front. The printed product is thus finished and ready to be shipped.

The device 1 can be operated basically automatically and continuously. The printing machine can thus print without interruption, so that different series and also small editions of books and other printed products can be printed. Without interruption, a second book can be printed after a first book has been completed. Subsequently, the first book or a third book can be printed. Accordingly, on the blades 17 different sheets 12 are gathered. in principle, the pre-product 11 can also be comprised of a single sheet 12. In general, a pre-product 11, however, is comprised of several sheets 12.

Figure 5:
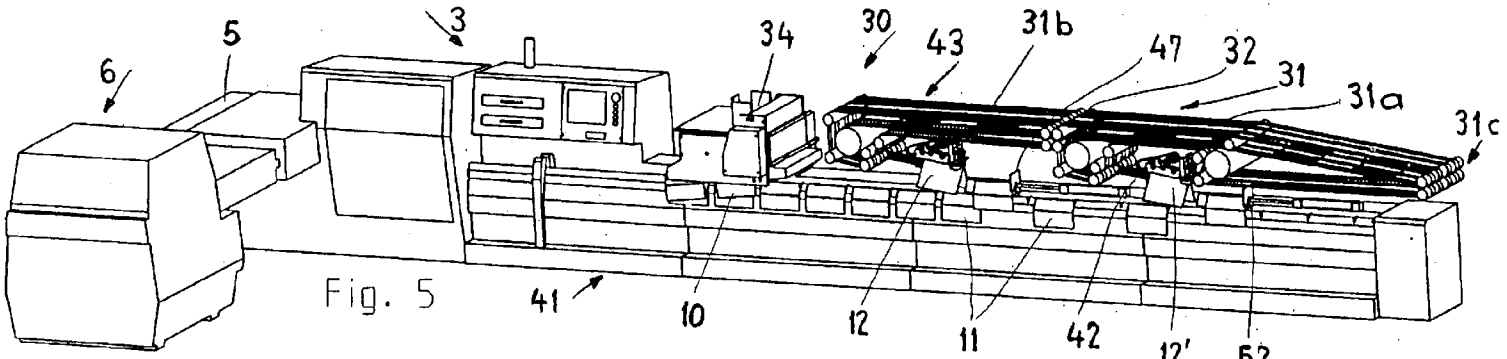
FIG. 5 shows schematically a perspective view of another. embodiment of the device according to the invention.
Figure 6:
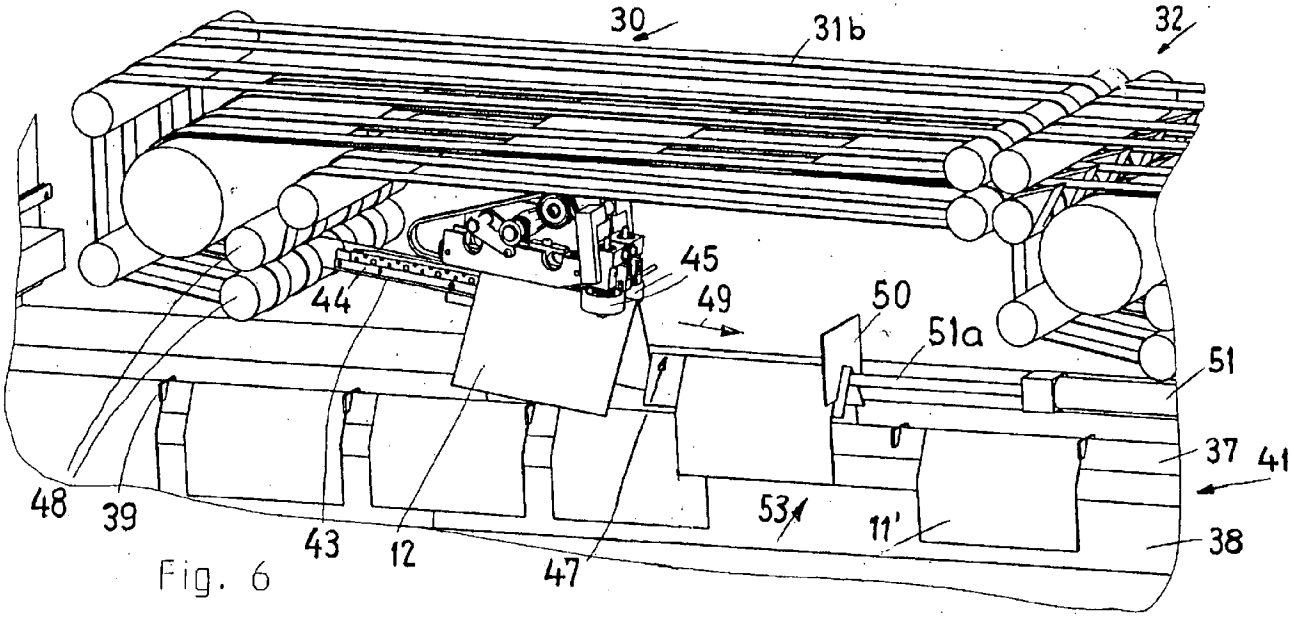
FIG. 6 shows schematically a perspective partial view of the device according to FIG. 5.

FIGS. 5 and 6 show a device 30 according to the invention which also enables a continuous operation and can be connected to a digital printing machine. The transversely folded sheets 12, which are already provided with a signature fold, are transported to a transport device 31 which is, for example, a belt transporter. This transport device 31 is comprised of a first transport member 31*a* and a second transport member 31*b* between which a deflecting switch 32 is arranged. The transport in FIG. 5 is carried out from the right to the left. The transversely folded sheets 12 are engaged by two rollers 31*c*. The transport device 31 extends above a further transport device 41 which, for example, is formed by a double gathering chain, known in the art. Above this additional transport device 41, two continuous folding devices 42 and 43 and two blades 47 and 52 are arranged at a spacing to one another. The blade 47 is correlated with the continuous folding device 43 and the blade 52 with the continuous folding device 42. Moreover, the continuous folding device 42 and the blade 52 are positioned underneath the transport member 31*a* and the continuous folding device 43 as well as the blade 47 underneath the transport member 31*b*. The two continuous folding devices 42 and 43 and the two blades 47, 52 form a gathering, device 53 for producing pre-products 11. The deflecting switch 32 can be actuated such the sheets 12 are supplied either to the continuous folding device 43 or to the continuous folding device 42.

In FIG. 6, the deflecting switch 32 is in such a position that the sheets 12 reach via two rollers 48 the folding blade 44 of the continues folding device 43. The sheets 12 are provided on the blade 44 with a longitudinal fold in a way known in the art by means of the continues folding device 43 and are dropped between two rollers 45 in the direction of arrow 49 onto the blade 47. Sequentially, so many sheets 12 are now deposited on the blade 47 as required for completing the pre-product 11. When the first sheet 12 of the next pre-product reaches the transport member 31*a*, the deflecting switch 32 is switched and this sheet as well as the subsequent sheets of the next pre-product 11' are guided to the continuous folding device 42. In this folding device 42, the sheets 12' are provided with a longitudinal fold and dropped onto the blade 52. When the pre-product 11' is complete, the deflecting switch 32 is again switched and gathering continues on the blade 47. With this process, there is sufficient time for dropping the pre-product 11 onto the transport device 41.

In order to drop a pre-product 11 onto the transport device 41, the blade 47 is moved by means of a drive 51 parallel to the moving direction of a gathering chain 37 into a retracted position and the pre-product 11 is retained on a stripper 50. The drive 51 is, for example, a piston-cylinder unit with a piston rod 51*a* to which the blade 47 is attached. Upon retraction of the blade 47, the pre-product 11 drops onto the gathering chain 37 and, in this way, is entrained by a driver 39. In FIG. 6 the pre-product 11 is transported on the gathering chain 37 from the right to the left. The pre-products 11 and 11' are guided by a guide plate 38. The pre-products 11 and 11' are transported in the same transport direction to an envelope feeder 34 and provided with an envelope 10. Subsequently, the pre-products 11 and 11', now provided with an envelope, are processed by the stitching machine 3, the deflection device 5, and the trimmer 6 to produce the finished product, as explained above.

Figures 7, 8, 9, 10:
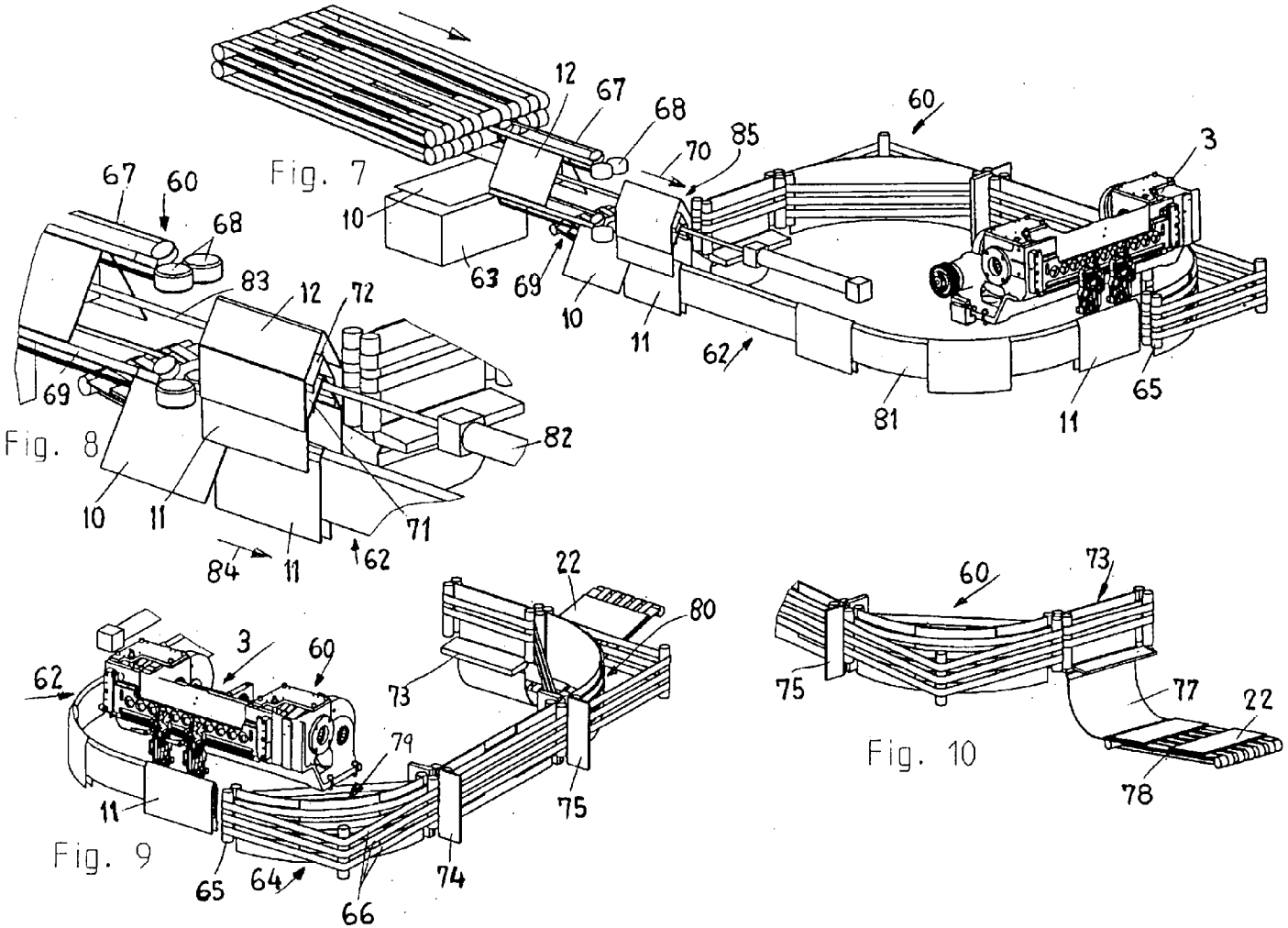
FIG. 7 shows schematically a perspective view of another embodiment of the device according to the invention.
FIG. 8 shows schematically a perspective partial view of the device according to FIG. 7.
FIG. 9 shows a further schematic perspective view of the device according to FIG. 7.
FIG. 10 shows schematically a perspective partial view of the device according to FIG. 7.

FIGS. 7 through 10 show a device 60 according to the invention in which sheets 12, also produced by a digital printing machine 14, are processed to a printed product 22, for example, a book or a brochure. The already transversely folded sheets 12, preferably perforated in the longitudinal direction, are folded in a continuous folding device 67 and are transferred between two rollers 68 in the direction of arrow 70 onto a first blade 71 (FIG. 8) or a second blade 72. The first blade 71 and the second blade 72, as shown in FIG. 8, are arranged above one another and form a gathering device 85. They are also positioned above a transport device 62 and are provided with a drive 82 and 83 with which the slides or blades 71 and 72 can be moved independently from one another between a gathering position and a retracted position. In FIG. 8 the gathering position is illustrated, respectively. By means of the drive 82 the slide 71 can be moved into the retracted position. The slide 72 is moved by the drive 83, for example, to the left into a retracted position by a linear movement. These movements are carried out parallel to the transport direction of the transport device 62.

On the two blades 71 and 72 gathering is carried out alternatingly. In the initial position, the first blade 71, for example, is in the gathering position of FIG. 8. The second upper blade 72 is instead in a retracted position (not illustrated). The sheets 12 reach the, first blade 71 after leaving the continuous folding device 67. When the pre-product 11 is complete, the second blade 72 is moved into the gathering position illustrated in FIG. 8. The pre-product 11 gathered on the first blade 71 can now be deposited onto the transport device 62 by retraction. of the first blade 71 by means of the drive 82, and, subsequently, an envelope 10 is added by means of a further continuous folding device 69. The envelope 10, according to FIG. 7, is removed from a stack 63. The pre-product 11 provided with the envelope. 10 is moved in FIG. 8 in the direction of arrow 84 to a stitching device 3. The transport device 62 moves, the pre-product 11 about a curved part 81 of about 90 degrees and can be provided, for example, with a double gathering chain, known in the art, which transports the pre-product 11 by means of drivers (not illustrated). After completion of another possible deflection of approximately 90 degrees, the pre-products 11 are individually stitched at their back or bound in a different way. Stitching machines 3 which operate continuously are known. However, a configuration is conceivable in which stitching is carried out as soon as the pre-product has been stopped, i.e., intermittent stitching is performed.

After stitching, the pre-product 11 is moved between rollers 65 into a belt transport device 64. In this belt transport device 64, the vertically aligned pre-products 11 are secured between belts 66 and transported upright. After a further possible deflection about approximately 90 degrees in the area of a curved part 79, the pre-products 11 reach a bottom trimming knife 74 which extends vertically and a bottom cut is carried out on each pre-product 11. Subsequently, the pre-products 11 are transported to a top knife 75 arranged at a spacing to the bottom knife 74 and extending also vertically. By means of the top knife 75 a top cut is performed on each pre-product 11. After a possible further deflection by 90 degrees in the area of a curved part 80, the pre-products 11, already cut at the bottom and the top, are transported to a front knife 73 which extends horizontally and performs a frontal cut on each pre-product 11. Subsequently, the pre-products 11 reach a delivery belt 78 via a chute 77. The finished products 22 can now be removed from the delivery belt 78. The transport of the pre-products 11 to the knives 74, 75, and 73 is preferably controlled depending on the size (format) of the product. It is thus possible to cut pre-products 11 of different sizes without interruption. The device 60 according to FIGS. 7 through 10 provides with the aforementioned multiple curved parts where the pre-products are deflected a very compact configuration requiring only minimal space. As explained above, it is thus possible to produce in combination with a digital printing machine even small editions in an inexpensive way.

While specific embodiments of the invention have been shown and described in detail to illustrate the inventive principles, it will be understood that the invention may be embodied otherwise without departing from such principles.

What is claimed is:

1. A device for producing bound printed products, comprising:

at least one continuous folding device to which are supplied sequentially individual printed sheets and in which the printed sheets are folded individually to folded printed sheets;

a gathering device in which the folded printed sheets received from the at least one continuous folding device are gathered in a position in which the folded printed sheets are astraddle to form pre-products of a predetermined number of the folded printed sheets;

a transport device arranged downstream of the gathering device and configured to receive the pre-products from the gathering device;

wherein the gathering device comprises at least one blade extending substantially parallel to a transport direction of the transport device, wherein the folded printed sheets are gathered on the at least one blade to form the pre-products; and means for moving the at least one blade in the transport direction.

2. The device according to claim 1, wherein the gathering device has at least two of the blades and the pre-products are gathered sequentially on the two blades.

3. The device according to claim 2, wherein the at least two blades are movable from a gathering position into a waiting position and from the waiting position into the gathering position.

4. The device according to claim 3, wherein the pre-products are dropped onto the transport device when the at least two blades move from the gathering position into the waiting position, respectively.

5. The device according to claim 3, wherein the at least two blades are arranged one above the other and above the transport device.

6. The device according to claim 5, wherein the at least two blades extend parallel to the transport direction.

7. The device according to claim 2, wherein the gathering device comprises a deflecting switch and supplies the printed sheets alternatingly to a first one or a second one of the at least two blades.

8. The device according to claim 7, wherein the first and second blades have a first one and a second one of the at least one continuous folding device correlated therewith, respectively, wherein the first and second continuous folding devices are arranged at a spacing to one another above the transport device.

9. The device according to clean 7, wherein the pre-products are transferred onto the transport device by being stripped off the first and second blades.

10. The device according to claim 1, wherein the transport device comprises a gathering chain provided with drivers positioned at identical spacing to one another along the gathering chain and configured to transport the pre-products.

11. The device according to claim 1, wherein the printed sheets are printed sequentially in a digital printing machine.

12. The device according to claim 1, wherein the printed sheets are transversely folded in another folding device arranged upstream of the at least one continuous folding device.

13. The device according to claim 1, further comprising an envelope feeder arranged downstream of the gathering device.

14. A device for producing bound printed products, comprising:

at least one continuous folding device to which are supplied sequentially individual printed sheets and in which the printed sheets are folded individually to folded printed sheets;

a gathering device in which the folded printed sheets received from the at least one continuous folding device are gathered in a position in which the folded printed sheets are astraddle to form pre-products of a predetermined number of the folded printed sheets;

a transport device arranged downstream of the gathering device and configured to receive the pre-products from the gathering device;

wherein the gathering device comprises at least one blade extending substantially parallel to a transport direction of the transport device, wherein the folded printed sheets are gathered on the at least one blade to form the pre-products, and wherein the at least one blade is configured to move on an arc-shaped path from the continuous folding device to the transport device.

15. The device according to claim 14, wherein the gathering device has a wheel-shaped carrier on which several of the blades are supported, wherein the blades move sequentially into a position in which the folded printed sheets are received from the continuous folding device.

16. The device according to claim 15, wherein the blades are supported on a periphery of the wheel-shaped carrier such that the, blades are aligned in a horizontal position and movable in a plane.

17. The device according to claim 16, wherein the blades have a first end attached to the wheel-shaped carrier.

18. The device according to claim 15, wherein the wheel-shaped carrier has a rotational axis extending transversely to the transport direction of the transport device.

19. The device according to claim 15, wherein the blades are divided in a longitudinal direction thereof, respectively, and wherein during gathering of the folded printed sheets on the blades the blades move past the transport device from above in a downward direction.

* * * * *